US011678114B2

(12) United States Patent
Saito et al.

(10) Patent No.: US 11,678,114 B2
(45) Date of Patent: Jun. 13, 2023

(54) SOUND COLLECTION LOUDSPEAKER APPARATUS, METHOD AND PROGRAM FOR THE SAME

(71) Applicant: NIPPON TELEGRAPH AND TELEPHONE CORPORATION, Tokyo (JP)

(72) Inventors: Shoichiro Saito, Tokyo (JP); Kazunori Kobayashi, Tokyo (JP); Noboru Harada, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/259,857

(22) PCT Filed: Jul. 1, 2019

(86) PCT No.: PCT/JP2019/026026
§ 371 (c)(1),
(2) Date: Jan. 12, 2021

(87) PCT Pub. No.: WO2020/017284
PCT Pub. Date: Jan. 23, 2020

(65) Prior Publication Data

US 2021/0306742 A1 Sep. 30, 2021

(30) Foreign Application Priority Data

Jul. 17, 2018 (JP) ..... JP2018-133903

(51) Int. Cl.
*H04R 3/00* (2006.01)
*G10K 11/16* (2006.01)
(Continued)

(52) U.S. Cl.
CPC ..... *H04R 3/00* (2013.01); *H04R 1/08* (2013.01); *H04R 1/323* (2013.01); *G10K 11/16* (2013.01); *H04R 2499/13* (2013.01)

(58) Field of Classification Search
CPC . H04R 3/00; H04R 3/005; H04R 3/02; H04R 3/12; H04R 5/00; H04R 5/02;
(Continued)

(56) References Cited

U.S. PATENT DOCUMENTS

2009/0097669 A1* 4/2009 Kamiya ..... G10K 11/17854 381/71.4
2016/0183025 A1 6/2016 Layton et al.
2020/0020315 A1* 1/2020 Tachi ..... G10K 11/17854

FOREIGN PATENT DOCUMENTS

JP H11275695 A * 10/1999 ..... G10K 15/00
JP 2005-161873 A 6/2005
(Continued)

OTHER PUBLICATIONS

JP-3730042-B2 English Translation, Dated Jun. 2006.*
(Continued)

*Primary Examiner* — Thang V Tran

(57) ABSTRACT

Provided is a sound collection loudspeaker apparatus that makes it possible to intuitively distinguish which talker is talking, and improve the comfort of conversations, when performing in-vehicle conversation and conversations with people outside of a vehicle. The sound collection loudspeaker apparatus is installed in a vehicle. Two or more sound collection and amplification positions are assumed to be present inside the vehicle. The apparatus includes: a transfer function multiplying unit that, from a transfer function for transfer from a desired sound source position where a sound image of an enhanced signal is localized to both ears of a target person located at the sound collection and amplification position, and a transfer function for transfer
(Continued)

from one or more speakers installed for playing back sound at the sound collection and amplification position to the ears, applies a filter for localizing a sound image at the sound source position to an enhanced signal, and outputs the enhanced signal that has been filtered to the speaker. The enhanced signal is a signal in which a target sound emitted from the sound collection and amplification position has been enhanced from a signal collected by the one or more microphones.

3 Claims, 17 Drawing Sheets

(51) Int. Cl.
*H04R 1/08* (2006.01)
*H04R 1/32* (2006.01)

(58) Field of Classification Search
CPC . H04R 1/00; H04R 1/08; H04R 1/323; H04R 2499/13; H04S 1/002; H04S 3/002; H04S 7/00; H04S 7/30; H04S 7/302; B60R 11/02; B60R 11/0217; B60R 11/0241; B60R 11/0247; B60R 16/00; B60R 16/023; G10L 21/02; G10K 11/00; G10K 11/16; G10K 11/178; G10K 11/1781; G10K 11/1785
See application file for complete search history.

(56) References Cited

FOREIGN PATENT DOCUMENTS

JP 3730042 B2 * 12/2005 ..... H04B 7/0842
JP 2012-199801 A 10/2012

OTHER PUBLICATIONS

Nippon Telegraph and Telephone Corporation (2018) "About 'Intelligent Microphone' Technology for Cars" online dated of Feb. 19, 2018, Nippon Telegraph and Telephone Corporation, May 24, 2018, Retrieved from URL:http://www.ntt.co.jp/news2018/1802/pdf/180219c.pdf with its English translation generated by computer.

* cited by examiner

SOUND COLLECTION LOUDSPEAKER APPARATUS, METHOD AND PROGRAM FOR THE SAME

CROSS-REFERENCE TO RELATED APPLICATIONS

This application is a U.S. 371 Application of International Patent Application No. PCT/JP2019/026026, filed on 1 Jul. 2019, which application claims priority to and the benefit of JP Application No. 2018-133903, filed on 17 Jul. 2018, the disclosures of which are hereby incorporated herein by reference in their entireties.

TECHNICAL FIELD

The present invention relates to a sound collection and amplification technique which uses a microphone and a speaker to enable conversations to be had smoothly inside and outside a vehicle.

BACKGROUND ART

Functions known as "in-car communication", "conversation assistance", and the like are increasingly being provided in automobiles (see NON-PATENT LITERATURE 1). Such a function facilitates conversations by collecting the sound of the voice of a person occupying a front seat and playing back that voice to a rear seat. Some such functions also collect audio from the rear seat and play back that audio to the front seat. Making hands-free telephone calls while riding in a vehicle has also become popular in recent years. There is furthermore the precedent set by systems such as web conference, where conversations can be had among multiple people and distinctions can be made between each point of speech.

With in-car communication, speakers for amplifying the voice of a talker are installed near the ears, as illustrated in FIG. 1, which is effective in terms of enabling the voice to be presented at a low volume.

CITATION LIST

Non Patent Literature

[NON-PATENT LITERATURE 1] "Intelligent mic for car no gijutu ni tuite (About 'Intelligent Microphone' Technology for Cars)," [online], 2018, Nippon Telegraph and Telephone Corporation, [May 24, 2018]. Retrieved from <URL:http://www.ntt.co.jp/news2018/1802/pdf/180219c.pdf>

SUMMARY OF THE INVENTION

Technical Problem

However, when listening to amplified voice from a speaker near the ears, the voices of all talkers are heard from behind (see FIG. 2), and it is therefore difficult to distinguish which talker is currently talking. For example, in the case of FIG. 2, the voices of talkers F and E in the rear seat and call partners 1 and 2 are all heard from behind, and thus a call partner cannot be determined intuitively from the direction, position, and so on of the voice.

It is an object of the present invention to provide a sound collection loudspeaker apparatus, a method thereof, and a program which make it possible to intuitively distinguish which talker is talking, and improve the comfort of conversations, when performing in-car communication (in-vehicle conversation) and conversations with people outside of a vehicle.

Means for Solving the Problem

To solve the above-described problem, according to one aspect of the present invention, a sound collection loudspeaker apparatus is installed in a vehicle. Two or more sound collection and amplification positions are assumed to be present inside the vehicle. The apparatus includes: a transfer function multiplying unit that, from a transfer function for transfer from a desired sound source position where a sound image of an enhanced signal is localized to both ears of a target person located at the sound collection and amplification position, and a transfer function for transfer from one or more speakers installed for playing back sound at the sound collection and amplification position to the ears, applies a filter for localizing a sound image at the sound source position to an enhanced signal, and outputs the enhanced signal that has been filtered to the speaker. The enhanced signal is a signal in which a target sound emitted from the sound collection and amplification position has been enhanced from a signal collected by the one or more microphones.

To solve the above-described problem, according to another aspect of the present invention, a sound collection loudspeaker apparatus is installed inside a vehicle. At least one seat in a front row of the vehicle is a sound collection position, and at least one seat in a rear row of the vehicle is an amplification position. The apparatus includes: a speaker, installed for amplifying voice at the amplification position, the speaker being installed closer to the amplification position than the sound collection position and in a direction different from the sound collection position relative to the amplification position; and a microphone installed to collect sound emitted from the sound collection position. Sound picked up by the microphone is amplified from the speaker with a sound image of the sound having been localized to the sound collection position.

Effects of the Invention

According to the present invention, it is possible to intuitively distinguish which talker is talking, and improve the comfort of conversations, when performing in-vehicle conversation and conversations with people outside of a vehicle.

DESCRIPTION OF EMBODIMENTS

Figure 1:
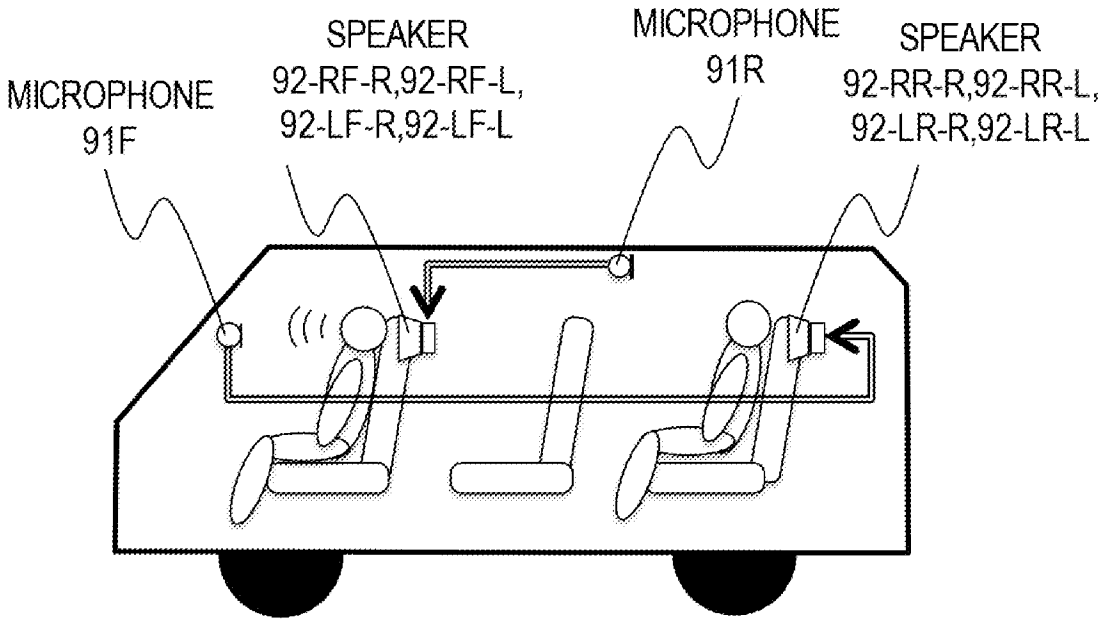
FIG. 1 is a diagram illustrating an example of a layout of microphones and speakers for in-car communication.

Embodiments of the present invention will be described below. In the figures referred to in the following descriptions, constituent elements having the same functions, steps performing the same processing, and the like will be given like reference numerals, and redundant descriptions thereof will not be given. Unless otherwise mentioned, the following descriptions will assume that processing carried out in units of elements of vectors, matrices, and so on is applied to all of those elements of vectors, matrices, and so on.

Points of the First Embodiment

The voice of a talker within a vehicle and of a talker who is a communication partner outside the vehicle are presented from a multi-channel speaker through filters which differ for each talker, and sound images are localized at separate locations, which makes it easier to intuitively understand which partner is talking.

First Embodiment

Figure 3:
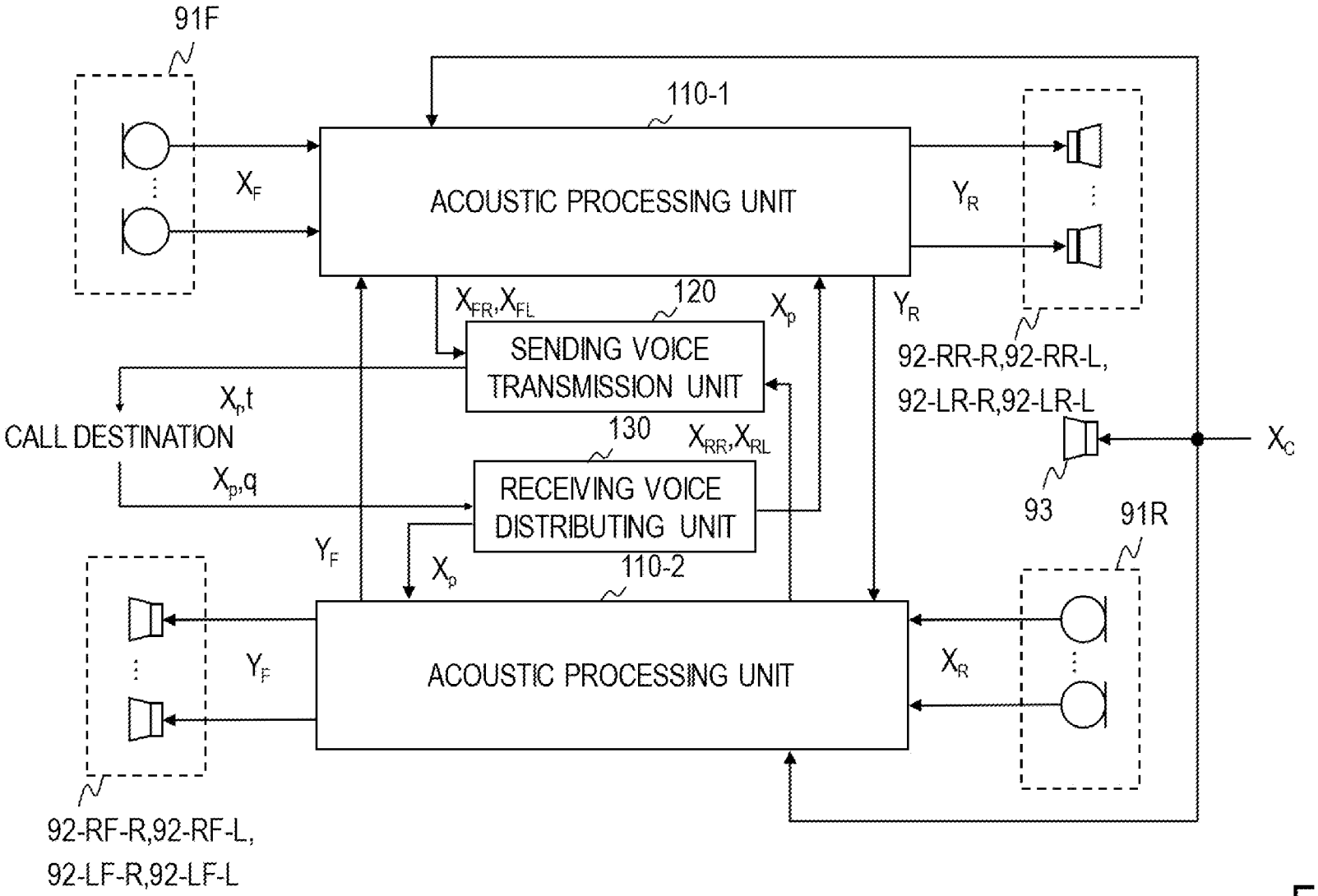
FIG. 3 is a function block diagram illustrating a sound collection loudspeaker apparatus according to a first embodiment.
Figure 4:
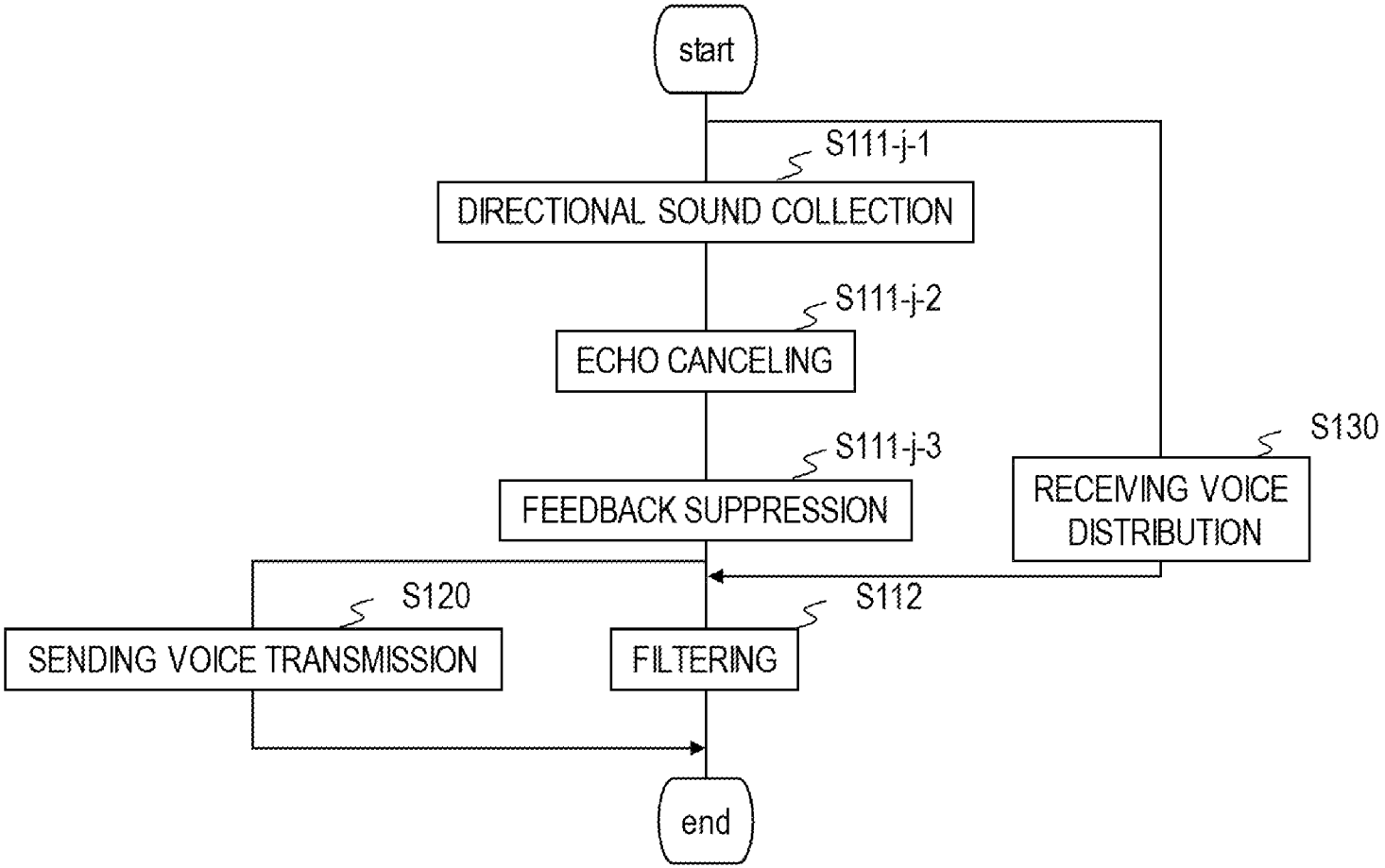
FIG. 4 is a diagram illustrating an example of a flow of processing by the sound collection loudspeaker apparatus according to the first embodiment.

FIG. 3 is a function block diagram illustrating a sound collection loudspeaker apparatus according to a first embodiment, and FIG. 4 illustrates a processing flow thereof.

The sound collection loudspeaker apparatus includes two acoustic processing units 110-*i*, a sending voice transmission unit 120, and a receiving voice distributing unit 130.

Figure 2:
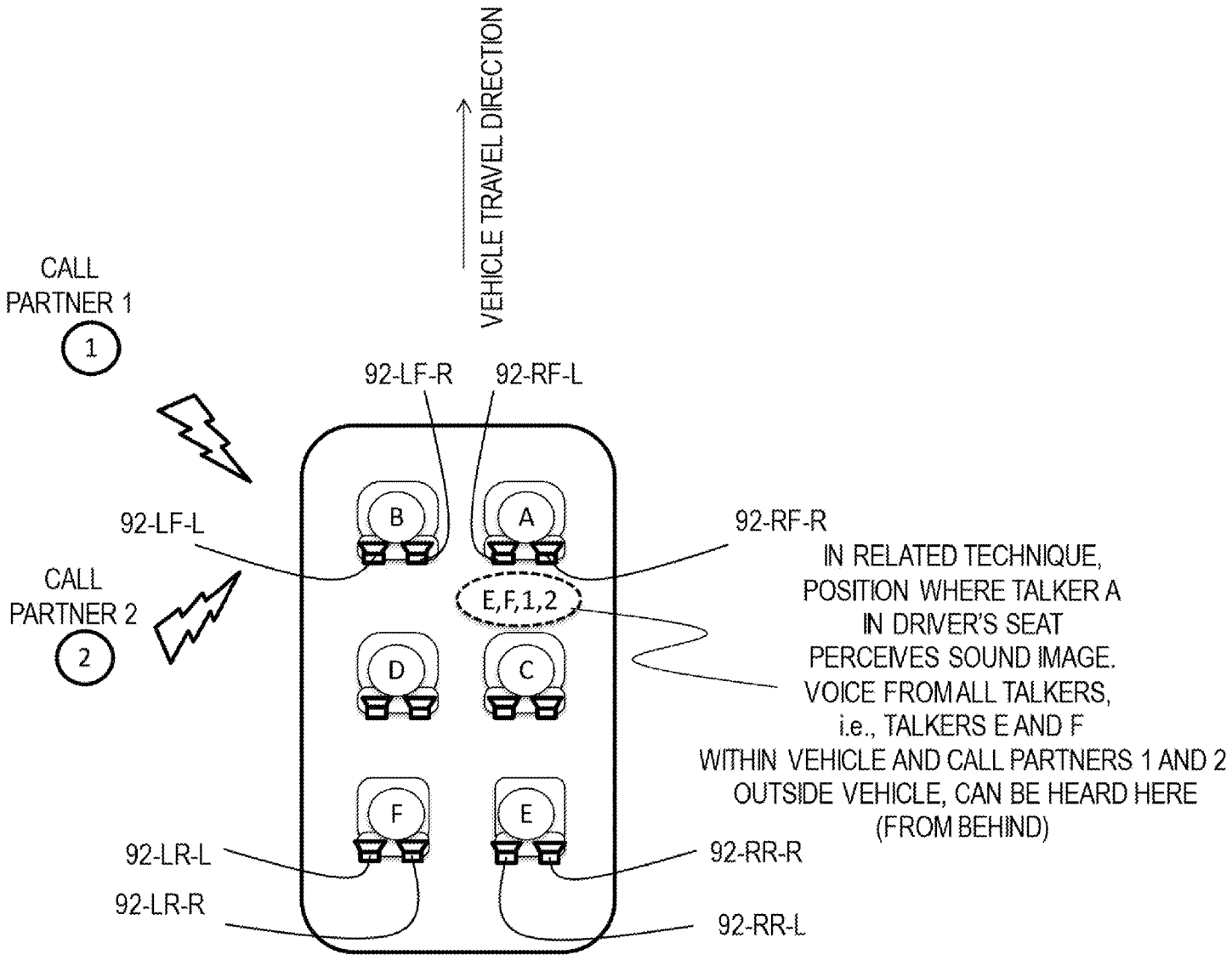
FIG. 2 is a diagram illustrating a localization position of a sound image in in-car communication.

In the present embodiment, a vehicle in which the sound collection loudspeaker apparatus is installed has the structure illustrated in FIG. 1 and FIG. 2, with three rows of seats. Furthermore, the vehicle according to the present embodiment has one seat each on the right and left sides of each row, and includes a microphone 91F which collects sound mainly of the voice of a talker in the first row, and a microphone 91R which collects sound mainly of the voice of a talker in the third row. Each of the microphones 91F and 91R is constituted by M microphones. Note that F and R indicate "front" and "rear", respectively, with respect to a travel direction of the vehicle. Furthermore, the vehicle according to the present embodiment includes a speaker for each of the left and right on each of seats in the first row and the third row. "R" and "L" are letters indicating the right side and the left side with respect to the travel direction of the vehicle. Furthermore, the eight speakers installed on the right side of a seat A on the right-front side of the vehicle, the left side of the seat A on the right-front side of the vehicle, the right side of a seat B on the left-front side of the vehicle, the left side of the seat B on the left-front side of the vehicle, the right side of a seat E on the right-rear side of the vehicle, the left side of the seat E on the right-rear side of the vehicle, the right side of a seat F on the left-rear side of the vehicle, and the left side of the seat F on the left-rear side of the vehicle are represented by 92-RF-R, 92-RF-L, 92-LF-R, 92-LF-L, 92-RR-R, 92-RR-L, 92-LR-R, and 92-LR-L, respectively. The positions of the seats A and B in the first row and the positions of the seats E and F in the third row, which are subject to sound collection and amplification, are also called "sound collection and amplification positions". Also note that "amplification" means using an amplification device such as a speaker to convert an electrical signal (a playback signal) into sound and emit that sound into space. In the amplification, the sound may be multiplied by a gain greater than 1 to emit the sound at a higher volume than the original sound, multiplied by a gain less than 1 to emit the sound at a lower volume than the original sound, or may be emitted without changing the volume (with a gain corresponding to 1).

The sound collection loudspeaker apparatus takes, as inputs, sound collection signals $X_F=[X_{F,1}, \ldots, X_{F,M}]$ and $X_R=[X_{R,1}, \ldots, X_{R,M}]$, a playback signal (e.g., an audio signal) $X_C=[X_{C,1}, \ldots, X_{C,N}]$, a receiving voice signal $X_p$ received from a call destination, and talker information q. Here, the sound collection signals $X_F$ and $X_R$ are signals obtained by collecting sound using two microphones 91F and 91R installed within the vehicle. The playback signal $X_C$ is a signal which is played back by a speaker 93 of an onboard acoustic device (e.g., a car audio system). Furthermore, the sound collection loudspeaker apparatus generates and outputs playback signals $Y_F=[Y_{RF-R}, Y_{RF-L}, Y_{LF-R}, Y_{LF-L}]$ and $Y_R=[Y_{RR-R}, Y_{RR-L}, Y_{LR-R}, Y_{LR-L}]$, a sending voice signal $X_r$ transmitted to the call destination, and talker information t, so that a sound image is localized at a virtual sound source position corresponding to the real talker. Here, the playback signals $Y_F$ and $Y_R$ are signals played back by the eight speakers 92-RF-R, 92-RF-L, 92-LF-R, 92-LF-L, 92-RR-R, 92-RR-L, 92-LR-R, and 92-LR-L. The signals $X_F$, $X_R$, $X_C$, $X_p$, $Y_F$, $Y_R$, and $X_r$ are complex number indications of given frequency components of the respective signals. Here, the signals $X_F$, $X_R$, $X_C$, $X_p$, $Y_F$, $Y_R$, and $X_r$ in the frequency domain may be input and output as-is. Alternatively, time domain signals may be input, and a frequency domain conversion unit (not shown) may be used to convert (e.g., through a Fourier transform or the like) the signals into the signals $X_F$, $X_R$, $X_C$, and $X_p$ in the frequency domain. Alternatively, the frequency domain signals $Y_F$, $Y_R$, and $X_r$ may be converted (e.g., through an inverse Fourier transform or the like) into signals in the time domain using a time domain conversion unit (not shown) and output. N represents the number of channels in the playback signal played back by the speaker 93 of the onboard acoustic device.

The sound collection loudspeaker apparatus is a special device configured by loading a special program into a known or dedicated computer including, for example, a central processing unit (CPU), a main storage device (RAM: Random Access Memory), and the like. The sound collection loudspeaker apparatus executes various types of processing under the control of the central processing unit, for example. Data input to the sound collection loudspeaker apparatus, data obtained from the various types of processing, and so on is, for example, stored in the main storage device, and the data stored in the main storage device is read out to the central processing unit and used in other processing as necessary. The various processing units of the sound collection loudspeaker apparatus may be at least partially constituted by hardware such as integrated circuits. The various storage units provided in the sound collection loudspeaker apparatus can, for example, be constituted by the main storage device such as RAM (Random Access Memory), or by middleware such as relational databases or key value stores. However, it is not absolutely necessary for the storage units to be provided within the sound collection loudspeaker apparatus; the units may be constituted by an auxiliary storage device including a hard disk, an optical disc, or a semiconductor memory element such as flash memory, and provided outside the sound collection loudspeaker apparatus.

Each unit will be described hereinafter.

<Acoustic Processing Unit 110-*i*>

One of the acoustic processing units 110-*i* takes, as inputs, the sound collection signal $X_F=[X_{F,1}, \ldots, X_{F,M}]$, the playback signal $Y_F=[Y_{RF\text{-}R}, Y_{RF\text{-}L}, Y_{LF\text{-}R}, Y_{LF\text{-}L}]$, the playback signal $X_C=[X_{C,1}, \ldots, X_{C,N}]$, and the receiving voice signal $X_p$ received from the call destination. Here, the sound collection signal $X_F$ is a signal in which the voice mainly of a talker in the first row has been collected by the microphone 91F. The playback signal $Y_F$ is a signal played back by the speakers 92-RF-R, 92-RF-L, 92-LF-R, and 92-LF-L of the seats in the first row, generated by the other of the acoustic processing units 110-*i*' (where i' is 1 or 2, and i≠i'). In other words, sounds emitted from a position corresponding to a sound source which emits a sound for which the sound image is to be localized (the sound collection signal $X_F$ and the receiving voice signal $X_p$), and sounds which are emitted from somewhere aside from that sound source and for which acoustic signals can be obtained (the playback signals $Y_F$ and $X_C$) are input. The one of the acoustic processing units 110-*i* generates and outputs the playback signal $Y_R=[Y_{RR\text{-}R}, Y_{RR\text{-}L}, Y_{LR\text{-}R}, Y_{LR\text{-}L}]$ an enhanced signal $X_{FR}$ and an index of the seat thereof, and an enhanced signal $X_{FL}$ and an index thereof. Here, the playback signal $Y_R$ is a signal played back by the speakers 92-RR-R, 92-RR-L, 92-LR-R, and 92-LR-L of the seats in the third row. Additionally, the enhanced signal $X_{FR}$ is a signal obtained by enhancing a target sound, emitted from the right-front seat of the vehicle, from the sound collection signal $X_F=[X_{F,1}, \ldots, X_{F,M}]$. The enhanced signal $X_{FL}$ is a signal obtained by enhancing a target sound, emitted from the left-front seat of the vehicle, from the sound collection signal $X_F=[X_{F,1}, \ldots, X_{F,M}]$. Although the playback signals played back by the speakers of the seats in the third row are generated in the present embodiment, the playback signals played back by the speakers in any row may be generated as long as that row is toward the rear with respect to the direction in which the vehicle is facing.

The other acoustic processing unit 110-*i*' takes, as inputs, the sound collection signal $X_R=[X_{R,1}, \ldots, X_{R,M}]$ in which the voice mainly of a talker in the third row has been collected by the microphone 91R, the playback signal $Y_R=[Y_{RR\text{-}R}, Y_{RR\text{-}L}, Y_{LR\text{-}R}, Y_{LR\text{-}L}]$, the playback signal $X_C=[X_{C,1}, \ldots, X_{C,N}]$, and the receiving voice signal $X_p$ received from the call destination. Here, the playback signal $Y_R$ is the signal generated by the one acoustic processing unit 110-*i* and played back by the speakers 92-RR-R, 92-RR-L, 92-LR-R, 92-LR-L of the seats in the third row. The other acoustic processing unit 110-*i*' generates and outputs the playback signal $Y_F=[Y_{RF\text{-}R}, Y_{RF\text{-}L}, Y_{LF\text{-}R}, Y_{LF\text{-}L}]$, an enhanced signal $X_{RR}$ and an index of the seat thereof, and an enhanced signal $X_{RL}$ and an index thereof. Here, the playback signal $Y_F$ is a signal played back by the speakers 92-RF-R, 92-RF-L, 92-LF-R, and 92-LF-L of the seats in the first row. Additionally, the enhanced signal $X_{RR}$ is a signal obtained by enhancing a target sound, emitted from the right-rear seat of the vehicle, from the sound collection signal $X_R=[X_{R,1}, \ldots, X_{R,M}]$. The enhanced signal $X_{RL}$ is a signal obtained by enhancing a target sound, emitted from the left-rear seat of the vehicle, from the sound collection signal $X_R=[X_{R,1}, \ldots, X_{R,M}]$.

Figure 5:
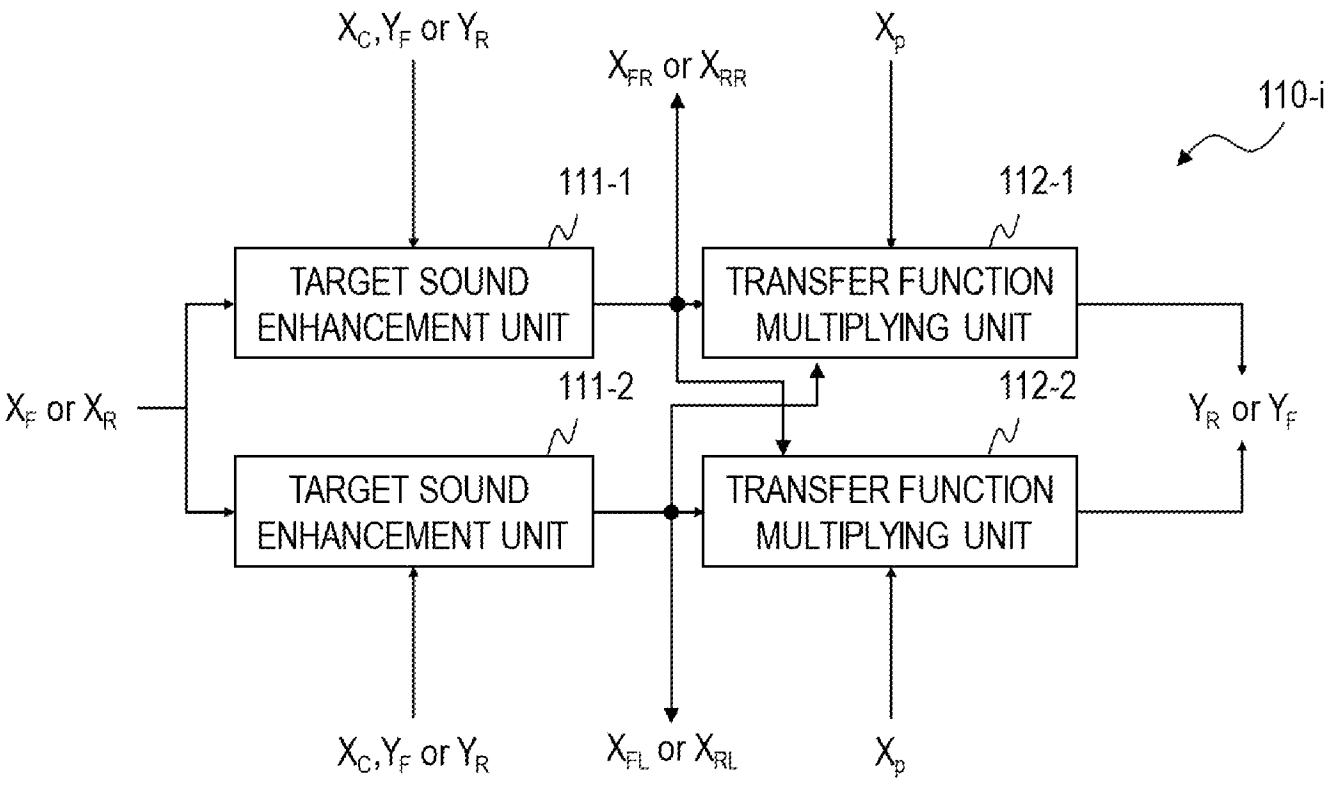
FIG. 5 is a function block diagram illustrating an acoustic processing unit according to the first embodiment.

The acoustic processing unit 110-*i* includes two target sound enhancement units 111-*j* and two transfer function multiplying units 112-*k*. Here, i=1, 2, j=1, 2, and k=1, 2. Although two of the target sound enhancement units 111-*j* are provided in the present embodiment in order to enhance target sounds emitted from two seats, namely on the left-front (the passenger seat) and the right-front (the driver's seat) of the vehicle, the same number of target sound enhancement units 111-*j* as there are target sounds to be enhanced may be provided. FIG. 5 is a function block diagram illustrating the acoustic processing unit 110-*i*. Each unit will be described hereinafter. Although only one of the acoustic processing units 110-*i* will be described hereinafter, the other acoustic processing unit 110-*i*' may simply carry out the same signal processing in accordance with the input signals and output signals, and thus descriptions thereof will not be given.

<Target Sound Enhancement Units 111-*j*>

One of the target sound enhancement units 111-*j* takes the sound collection signal $X_F=[X_{F,1}, \ldots, X_{F,M}]$ in which the voice mainly of a talker in the first row has been collected by the microphone 91F, the playback signal $Y_F=[Y_{RF\text{-}R}, Y_{RF\text{-}L}, Y_{LF\text{-}R}, Y_{LF\text{-}L}]$, and the playback signal $X_C=[X_{C,1}, \ldots, X_{C,N}]$ as inputs, finds the enhanced signal $X_{FR}$, and outputs that enhanced signal. Here, the playback signal $Y_F$ is the signal generated by the other acoustic processing unit 110-*i*' and played back by the speakers 92-RF-R, 92-RF-L, 92-LF-R, and 92-LF-L of the seats in the first row. Additionally, the enhanced signal $X_{FR}$ is a signal obtained by enhancing a target sound (a sound emitted from the right-front seat) from the sound collection signal $X_F=[X_{F,1}, \ldots, X_{F,M}]$.

The other target sound enhancement unit 111-*j*' (where (j' is 1 or 2, and j≠j') takes the same signals as the target sound enhancement unit 111-*j* as inputs, finds, from the sound collection signal $X_F=[X_{F,1}, \ldots, X_{F,M}]$, an enhanced signal $X_{FL}$ in which a target sound (a sound emitted from the left-front seat) has been enhanced, and outputs the enhanced signal.

Figure 6:
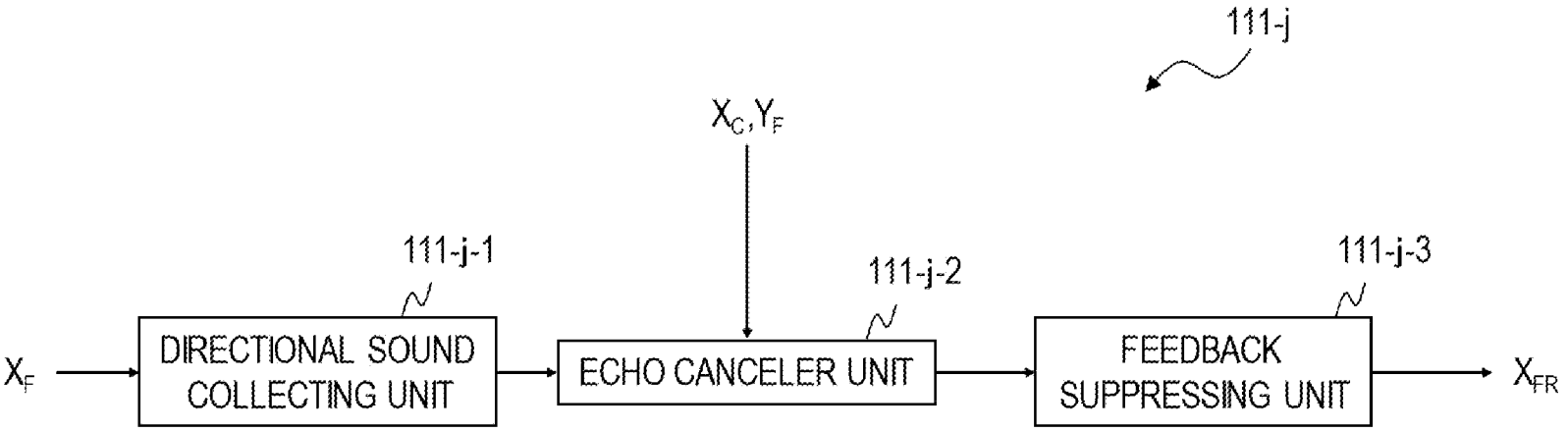
FIG. 6 is a function block diagram illustrating a target sound enhancement unit according to the first embodiment.

FIG. 6 is a function block diagram illustrating the target sound enhancement unit 111-*j*.

The target sound enhancement unit 111-*j* includes a directional sound collecting unit 111-*j*-1, an echo canceler unit 111-*j*-2, and a feedback suppressing unit 111-*j*-3. Each unit will be described hereinafter. Although only one of the target sound enhancement units 111-*j* will be described hereinafter, the other target sound enhancement unit 111-*j*' may simply carry out the same signal processing in accordance with the output signals, and thus descriptions thereof will not be given.

(Directional Sound Collecting Unit 111-*j*-1)

The directional sound collecting unit 111-*j*-1 takes the sound collection signal $X_F=[X_{F,1}, \ldots, X_{F,M}]$ as an input, and finds an enhanced signal $X'_{FR}$ (S111-*j*-1) in which the target sound (a sound emitted from the right-front seat) has been enhanced from the sound collection signal $X_F=[X_{F,1}, \ldots, X_{F,M}]$, and outputs the enhanced signal.

The enhanced signal may be found through any method. For example, an enhancement technique disclosed in Japanese Patent Application Publication No. 2004-078021 can be used.

(Echo Canceler Unit 111-*j*-2)

The echo canceler unit 111-*j*-2 takes the enhanced signal $X'_{FR}$, the playback signal $Y_F=[Y_{RF\text{-}R}, Y_{RF\text{-}L}, Y_{LF\text{-}R}, Y_{LF\text{-}L}]$, and the playback signal $X_C=[X_{C,1}, \ldots, X_{C,N}]$ as inputs. Then, by removing a sound component played back by the speaker 93, a sound component played back by the speakers 92-RF-R, 92-RF-L, 92-LF-R, and 92-LF-L, and so on contained in the enhanced signal $X'_{FR}$, the echo canceler unit 111-*j*-2 finds an enhanced signal $X''_{FR}$ from which an echo component has been removed (S111-*j*-2) and outputs that enhanced signal.

Figure 7:
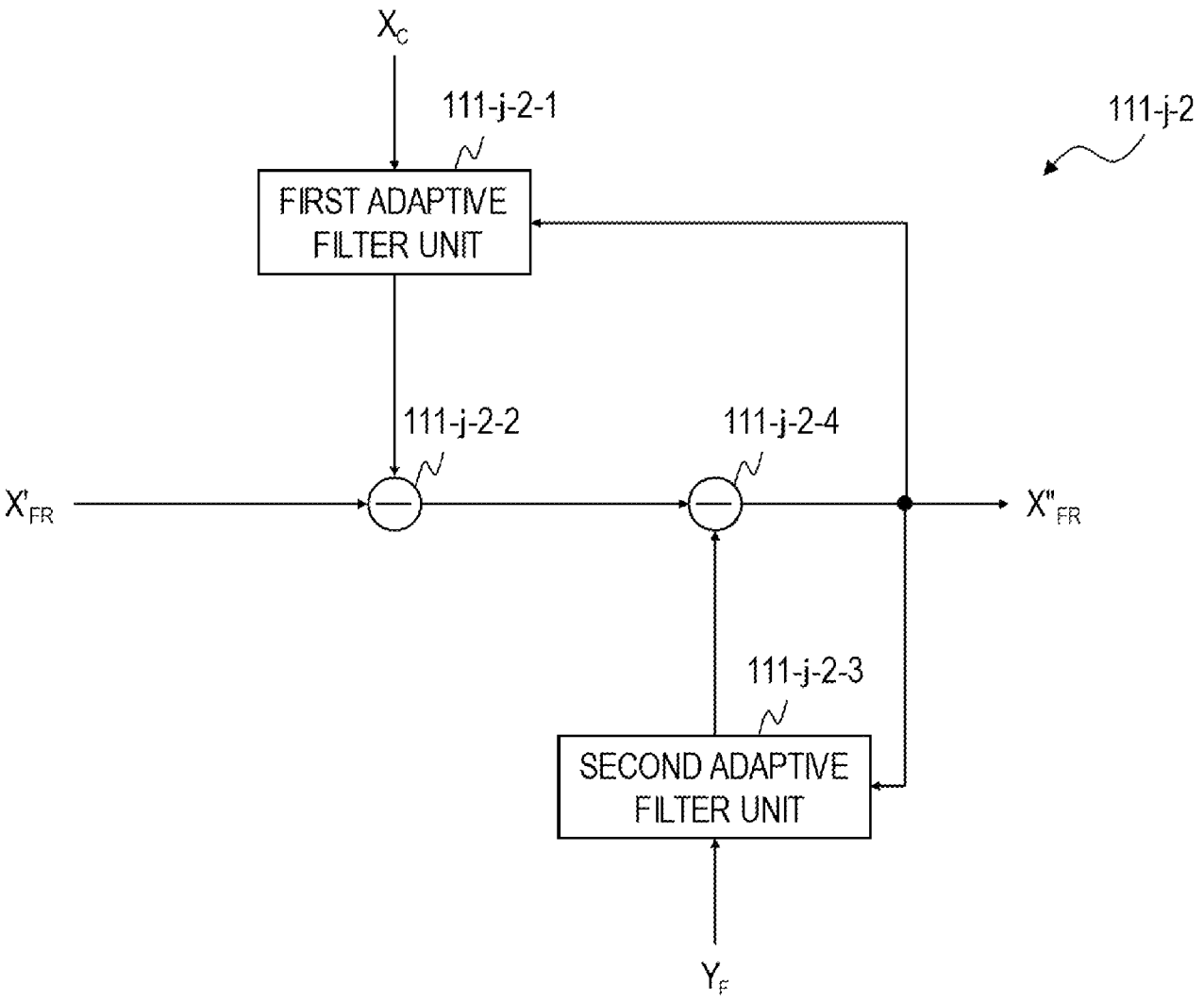
FIG. 7 is a function block diagram illustrating an echo canceler unit according to the first embodiment.

FIG. 7 is a function block diagram illustrating the echo canceler unit 111-*j*-2.

The echo canceler unit 111-*j*-2 includes a first adaptive filter unit 111-*j*-2-1, a first subtracting unit 111-*j*-2-2, a second adaptive filter unit 111-*j*-2-3, and a second subtracting unit 111-*j*-2-4.

The first adaptive filter unit 111-*j*-2-1 takes the playback signal $X_C=[X_{C,1}, \ldots, X_{C,N}]$ as an input, filters the playback signal $X_C$ using a first adaptive filter, and generates and outputs a first pseudo-echo $Y_1$.

The first subtracting unit 111-*j*-2-2 takes the enhanced signal $X'_{FR}$ and the first pseudo-echo $Y_1$ as inputs, subtracts the first pseudo-echo $Y_1$ from the enhanced signal $X'_{FR}$, and obtains and outputs an enhanced signal $X'_{FR,1}$. Note that the subtraction may be carried out individually from each of the channels, or collectively from a sum of all of the channels. For example, first pseudo-echoes $Y_{1,n}$ in N channels, obtained by filtering playback signals $X_{C,n}$ (n=1, 2, . . . , N) in N channels (where $Y_1=[Y_{1,1}, \ldots, Y_{1,N}]$), may be subtracted from the enhanced signal $X'_{FR}$ individually, or the sum of the first pseudo-echoes $Y_{1,n}$ in N channels may be subtracted from the enhanced signal $X'_{FR}$.

The second adaptive filter unit 111-*j*-2-3 takes the playback signal $Y_F=[Y_{RF\text{-}R}, Y_{RF\text{-}L}, Y_{LF\text{-}R}, Y_{LF\text{-}L}]$ as an input, filters the playback signal $Y_F$ using a second adaptive filter, and generates and outputs a second pseudo-echo $Y_2$.

The second subtracting unit 111-*j*-2-4 takes the enhanced signal $X'_{FR,1}$ and the second pseudo-echo $Y_2$ as inputs, subtracts the second pseudo-echo $Y_2$ from the enhanced signal $X'_{FR,1}$, and obtains and outputs an enhanced signal $X''_{FR}$. Like the first subtracting unit 111-*j*-2-2, the subtraction may be carried out individually from each of the channels, or collectively from a sum of all of the channels.

Furthermore, the first adaptive filter unit 111-*j*-2-1 takes the enhanced signal $X''_{FR}$ from which the echo component has been removed (corresponding to an error signal) as an input, and updates the first adaptive filter using the playback signal $X_C$ and the enhanced signal $X''_{FR}$. Likewise, the second adaptive filter unit 111-*j*-2-3 takes the enhanced signal $X''_{FR}$ as an input, and updates the second adaptive filter using the playback signal $Y_F$ and the enhanced signal $X''_{FR}$.

A variety of methods can be used as methods for updating the adaptive filters. For example, the filters may be updated using an NLMS algorithm or the like, as disclosed in Reference Document 1.

(Reference Document 1) Ohga, J., Yamazaki, Y., and Kaneda, Y., "*Onkyou Sisutemu to Dijitaru Syori* (Acoustic Systems and Digital Processing)", Institute of Electronics, Information and Communication Engineers (ed.), Corona, 1995, p 140, 141

Note also that the echo removal method is not limited to that described above, and the echo component may be removed through any method. For example, an echo removal technique disclosed in Japanese Patent Application Publication No. 2010-187086 can be used.

(Feedback Suppressing Unit 111-*j*-3)

The feedback suppressing unit 111-*j*-3 takes the enhanced signal $X''_{FR}$ as an input, suppresses a feedback component (S111-*j*-3), and outputs a post-feedback suppression signal as the enhanced signal $X_{FR}$.

Note that the feedback component may be suppressed through any method. For example, a feedback suppression technique disclosed in Japanese Patent Application Publication No. 2007-221219 can be used.

<Transfer Function Multiplying Unit 112-*k*>

One of the transfer function multiplying units 112-*k* takes the enhanced signals $X_{FR}$ and $X_{FL}$, and the receiving voice signal $X_p$, as inputs (see FIG. 5).

The transfer function multiplying unit 112-*k* applies a filter $G_{RR}$, for localizing the sound image to a virtual sound source position from the following two transfer functions, to the enhanced signals $X_{FR}$ and $X_{FL}$ and the receiving voice signal $X_p$ (S112), and outputs playback signals $Y_{RR\text{-}R}$ and $Y_{RR\text{-}L}$, which are the filtered enhanced signals, to the speakers 92-RR-R and 92-RR-L. The first of the transfer functions is a function for transfer from the virtual sound source position (e.g., the driver's seat or the passenger seat) to both ears of a target person located in the right-rear seat of the vehicle. The second of the transfer functions is a function for transfer from the two speakers 92-RR-R and 92-RR-L installed for playing back sound in the right-rear seat of the vehicle, to both ears.

The other transfer function multiplying unit 112-*k'* (where k' is 1 or 2, and k≠k') takes the enhanced signal $X_{RR}$ and $X_{RL}$, and the receiving voice signal $X_p$, as inputs.

The transfer function multiplying unit 112-*k'* applies a filter $G_{LR}$, for localizing the sound image to a virtual sound source position from the following two transfer functions, to the enhanced signals $X_{RR}$ and $X_{RL}$ and the receiving voice signal $X_p$ (S112), and outputs playback signals $Y_{LR\text{-}R}$ and $Y_{LR\text{-}L}$, which are the filtered enhanced signals, to the speakers 92-LR-R and 92-LR-L. The first of the transfer functions is a function for transfer from the virtual sound source position (e.g., the driver's seat or the passenger seat) to both ears of a target person located in the left-rear seat of the vehicle. The second of the transfer functions is a function for transfer from the two speakers 92-LR-R and 92-LR-L installed for playing back sound in the left-rear seat of the vehicle, to both ears.

In sum, the transfer function multiplying units 112-*k* apply the filters G for forming a sound image that differs for each talker to the enhanced signal, and finds playback signals of the speakers. It is assumed that the subsequent signals are expressed in the frequency domain. The same number of transfer function multiplying units 112-*k* are provided as there are seats for which sound is to be played back. In the present embodiment, there are two seats in the third row, and thus two transfer function multiplying units 112-*k* are provided as well.

Figure 8:
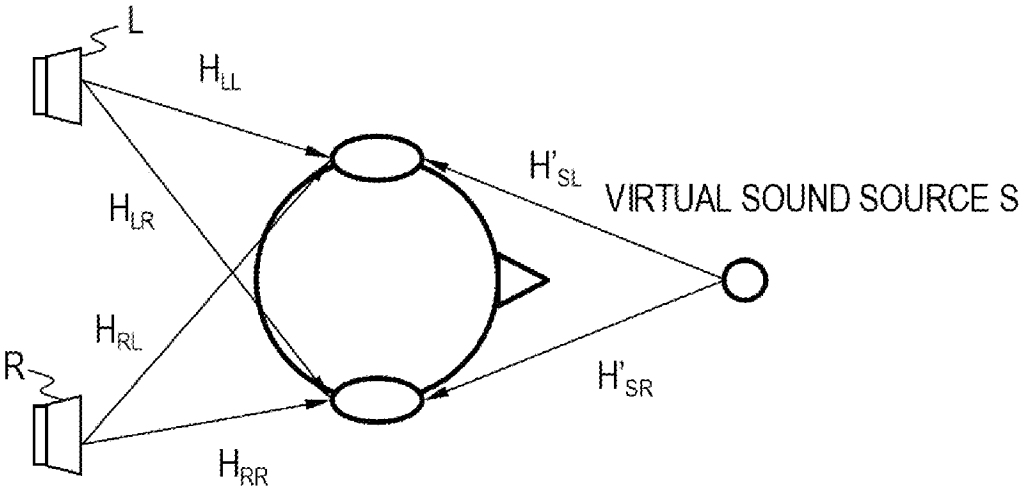
FIG. 8 is a diagram illustrating a method for finding a filter.

A method for finding the filters G will be described with reference to FIG. 8. First, transfer functions $H_{SL}'$ and $H_{SR}'$, from the position of a virtual sound source S to both ears, and transfer functions $H_{LL}$, $H_{LR}$, $H_{RL}$, and $H_{RR}$, from the two-channel speakers L and R located at the ears to the ears, are measured or found through simulations. When the transfer functions $H_{SL}'$, $H_{SR}'$, $H_{LL}$, $H_{LR}$, $H_{RL}$, and $H_{RR}$ are known (have already been measured), $G_{SL}$ and $G_{SR}$ are found as follows with respect to a sound source signal X.

$$X(G_{SL}\cdot H_{LL}+G_{SR}\cdot H_{RL})=X\cdot H_{SL}'$$

$$X(G_{SL}\cdot H_{LR}+G_{SR}\cdot H_{RR})=X\cdot H_{SR}' \quad \text{[Formula 1]}$$

These are found for the number of seats (e.g., the two seats subject to in-vehicle communication) and the number of P points corresponding to the call partners (where P is an integer of 1 or more).

Figure 9:
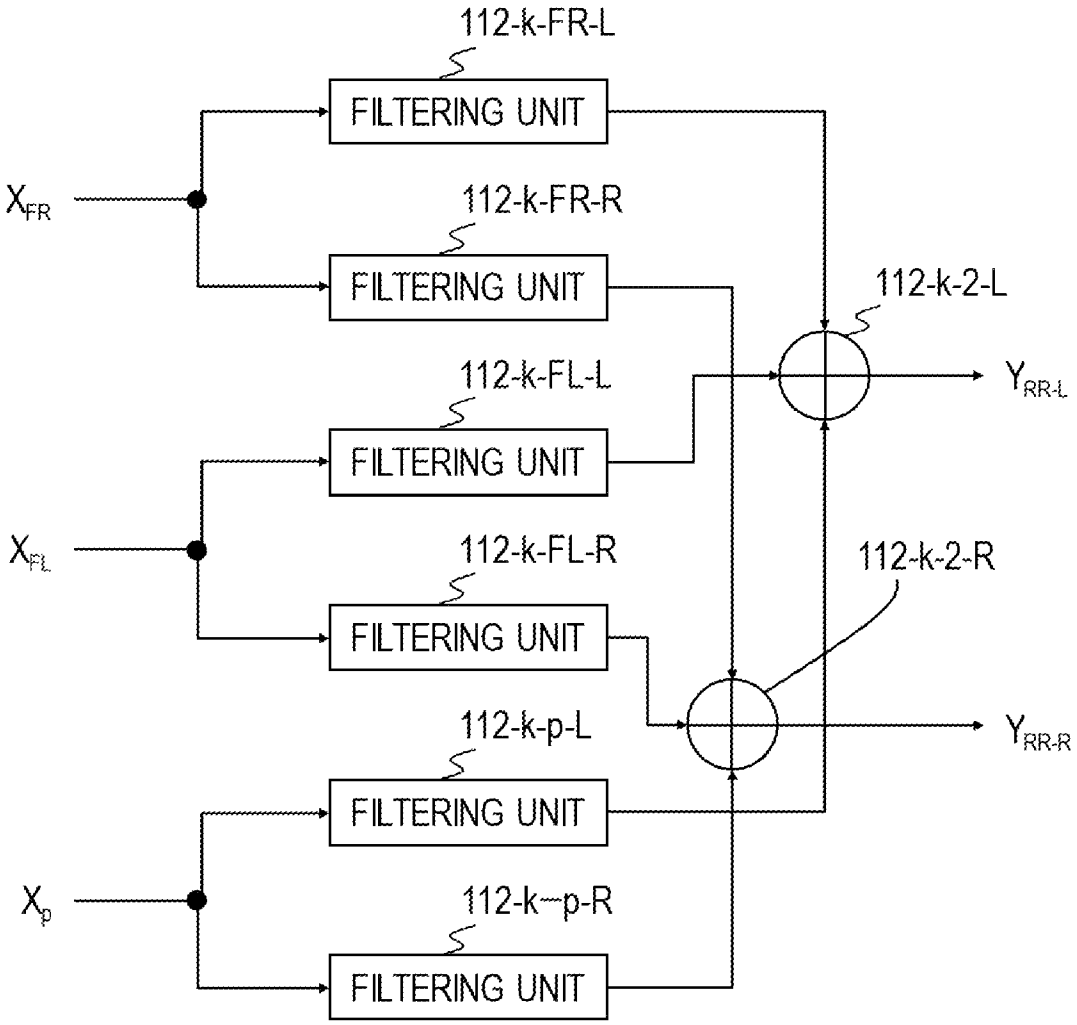
FIG. 9 is a function block diagram illustrating a transfer function multiplying unit according to the first embodiment.

FIG. 9 is a function block diagram illustrating the transfer function multiplying unit 112-*k*.

The transfer function multiplying unit 112-*k* includes six filtering units 112-*k*-FR-L, 112-*k*-FR-R, 112-*k*-FL-L, 112-*k*-FL-R, 112-*k*-*p*-L, and 112-*k*-*p*-R, and two adding units 112-*k*-2-L and 112-*k*-2-R. Although P=1 and the number of points corresponding to call partners is assumed to be 1 in the present embodiment, a number of filtering units corresponding to the number of points P×2 may be provided as necessary. Which transfer function multiplying unit the receiving voice signal $X_p$ is distributed to, and furthermore, which filtering unit in that transfer function multiplying unit the receiving voice signal $X_p$ is distributed to, is specified by a receiving voice distributing unit, which will be described below.

Two of the filtering units 112-*k*-FR-L and 112-*k*-FR-R take the enhanced signal $X_{FR}$ as an input, apply filters $G_{FR-L}$ and $G_{FR-R}$, respectively, and output filtered enhanced signals $G_{FR-L}X_{FR}$ and $G_{FR-R}X_{FR}$, respectively.

Two of the filtering units 112-*k*-FL-L and 112-*k*-FL-R take the enhanced signal $X_{FL}$ as an input, apply filters $G_{FL-L}$ and $G_{FL-R}$, respectively, and output filtered enhanced signals $G_{FL-L}X_{FL}$ and $G_{FL-R}X_{FL}$, respectively.

Two of the filtering units 112-*k*-*p*-L and 112-*k*-*p*-R take the receiving voice signal $X_p$ as an input, apply filters $G_{p-L}$ and $G_{p-R}$, respectively, and output filtered enhanced signals $G_{p-L}X_p$ and $G_{p-R}X_p$, respectively.

The adding unit 112-*k*-2-L takes the enhanced signals $G_{FR-L}X_{FR}$, $G_{FL-L}X_{FL}$, and $G_{p-L}X_p$ as inputs, adds these signals, and finds and outputs a playback signal $Y_{RR-L}$ ($=G_{FR-L}X_{FR}+G_{FL-L}X_{FL}+G_{p-L}X_p$).

The adding unit 112-*k*-2-R takes the enhanced signals $G_{FR-R}X_{FR}$, $G_{FL-R}X_{FL}$, and $G_{p-R}X_p$ as inputs, adds these signals, and finds and outputs a playback signal $Y_{RR-R}$ ($=G_{FR-R}X_{FR}+G_{FL-R}X_{FL}+G_{p-R}X_p$). Note that the above-described filter $G_{RR}$ can be expressed as $G_{RR}=[G_{FR-L}, G_{FR-R}, G_{FL-L}, G_{FL-R}, G_{p-L}, G_{p-R}]$.

(Virtual Sound Source Position)

The virtual sound source position may be any position at which the talker who is speaking can be distinguished, and may be different from the actual sound source position rather than coinciding with that position.

For example, the virtual sound source position and the actual sound source position are set to coincide for each seat within the vehicle, and a position different from the actual sound source position is set as the virtual sound source position for a call destination outside the vehicle. At this time, the virtual sound source position may be set to outside the vehicle in order to clarify that one is not conversing with a person within the vehicle.

Figure 10:
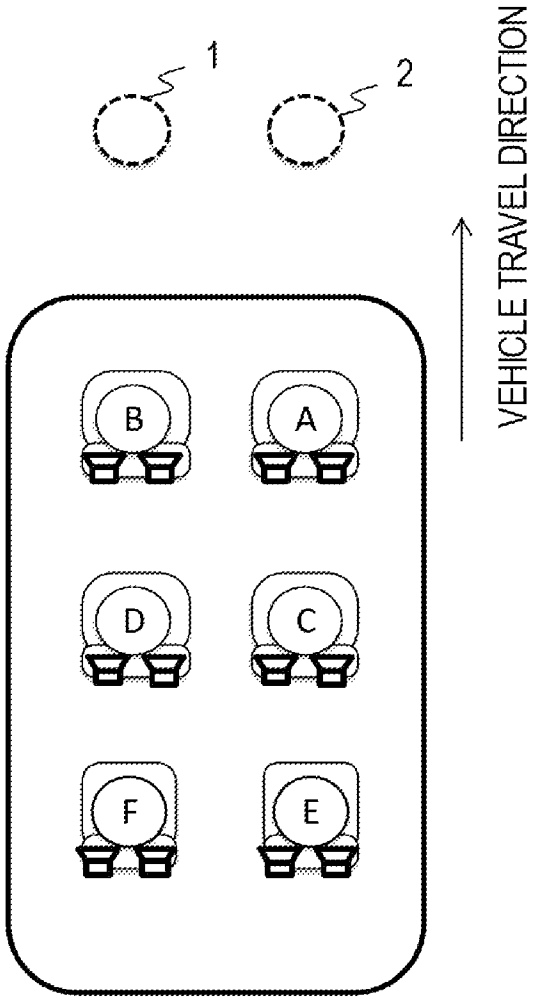
FIG. 10 is a diagram illustrating a virtual sound source position.
Figure 11:
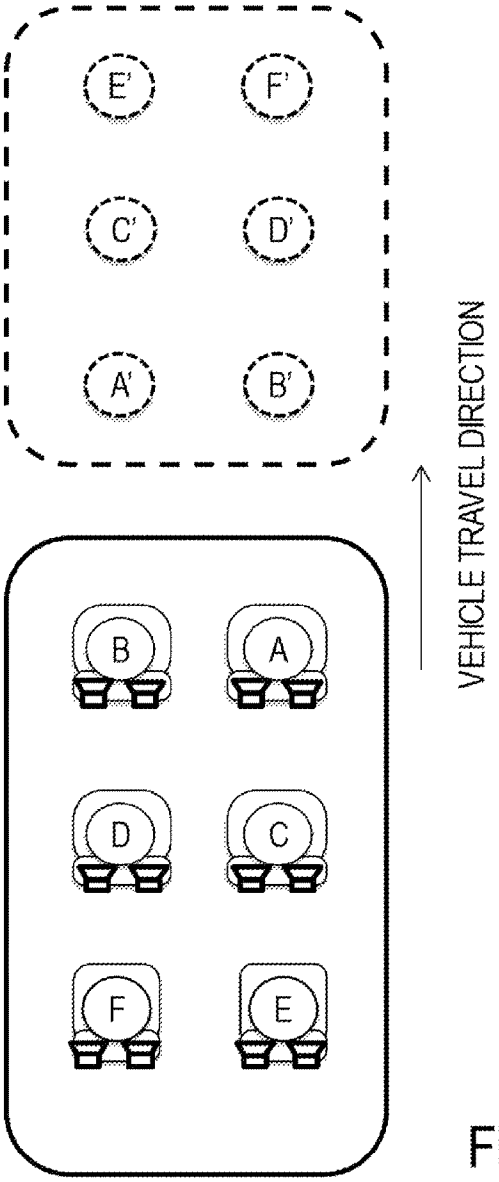
FIG. 11 is a diagram illustrating a virtual sound source position.

For example, when presenting through the speaker of the driver's seat (the right-front seat) or the passenger seat, virtual sound sources 1 and 2 are set as indicated in FIG. 10 and FIG. 11. For conversational voice within the vehicle, the rear seat corresponding to the actual sound source position is set, whereas the virtual sound source is set to the front when making a call with a partner outside the vehicle. For example, in a conversation with a plurality of points, such as a teleconference, localizing the voices at the front-left (the position of the virtual sound source 1) and the front-right (the position of the virtual sound source 2) makes it easier to distinguish between talkers.

Additionally, in a conversation with a similar vehicle having this system, the sound image is localized by performing a setting which has the partner vehicle facing the host vehicle in a virtual manner (FIG. 11). Seen from the driver's seat (the right-front seat) or the passenger seat, it is normally not possible for there to be a talker to the front, and thus it can be intuitively understood that sounds coming from the virtual sound sources indicated in FIG. 10 or FIG. 11 are from call partners outside the vehicle rather than talkers within the vehicle.

Figure 12:
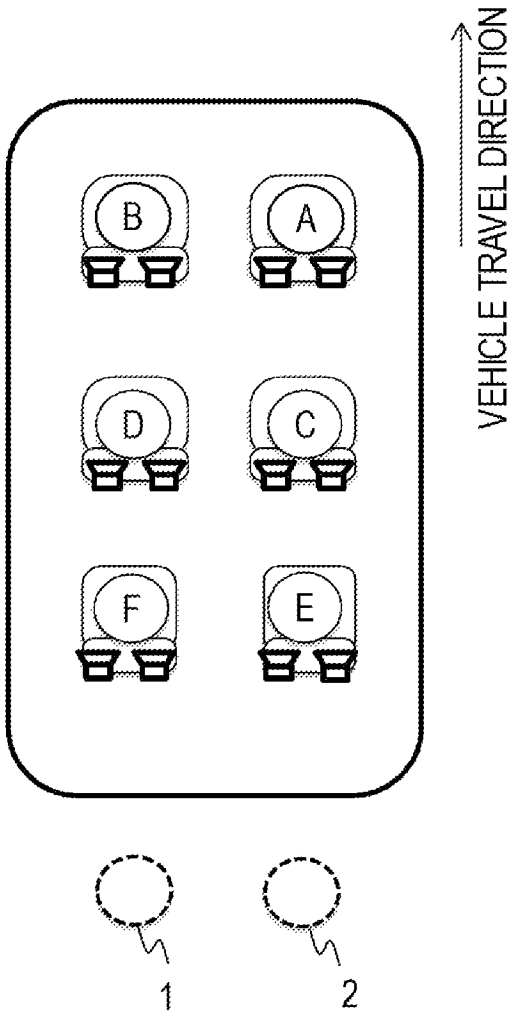
FIG. 12 is a diagram illustrating a virtual sound source position.
Figure 13:
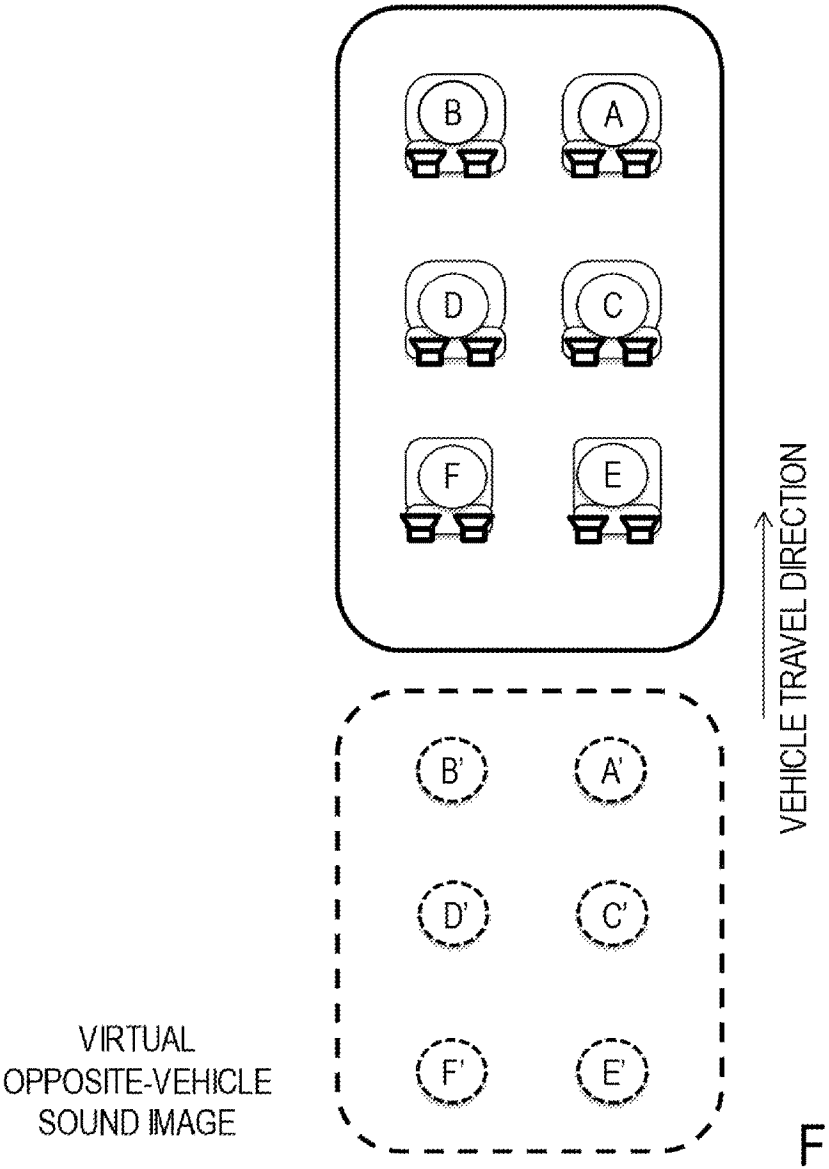
FIG. 13 is a diagram illustrating a virtual sound source position.

Conversely, for the rear seats, the sound image is localized as indicated in FIGS. 12 and 13. Presenting the sound images so as to be distinct from each other, and particularly distributing sounds from outside and inside the vehicle to the front and rear, respectively, is expected to enable natural conversations without the driver having to pay particular attention.

<Sending Voice Transmission Unit 120 and Receiving Voice Distributing Unit 130>

The sending voice transmission unit 120 takes the enhanced signals $X_{FR}$, $X_{FL}$, $X_{RR}$, and $X_{RL}$ as inputs, integrates the enhanced signals $X_{FR}$, $X_{FL}$, $X_{RR}$, and $X_{RL}$, generates a sending voice signal $X_r$, and generates and transmits corresponding talker information t (S120). Note that the talker information t includes information of the positions of the seats in the vehicle, which correspond to the enhanced signals $X_{FR}$, $X_{FL}$, $X_{RR}$, $X_{RL}$, and information of the sound collection and amplification position outside the vehicle, which corresponds to the call partner (e.g., information indicating the positions of the virtual sound sources 1 and 2 in FIG. 10, and information indicating seats A' to F' in the virtual opposite-vehicle sound image illustrated in FIG. 11).

The receiving voice distributing unit 130 takes the receiving voice signal $X_p$ and the talker information q from the transmission source as inputs, separates the receiving voice signal $X_p$ using the talker information q, and, on the basis of the talker information, distributes the separated receiving voice signal $X_p$ to one of the transfer function multiplying units 112-*k* in the respective acoustic processing units 110-*i* (S130).

Note that the talker information q includes information of the seat from which an utterance has been made (information q1 of the sound collection and amplification position, in the vehicle, corresponding to the receiving voice signal $X_p$) and information of the point of speech (information q2 of the sound collection and amplification position, outside the vehicle, corresponding to the call partner).

For example, the information can be exchanged with a call partner by storing the receiving voice signal $X_p$ and the sending voice signal $X_r$ in the data part of an RTP packet, and storing the talker information t and q in the header part.

Using the information indicating in which seat the talker currently being spoken with is located (information of the seat position, in the vehicle, corresponding to the receiving voice signal $X_p$), the receiving voice distributing unit 130 first determines the transfer function multiplying unit for playback. For example, when transmitting to the right-rear seat E of the vehicle, the transfer function multiplying unit 112-1 in the acoustic processing unit 110-1 is set as the transfer function multiplying unit for playback.

Next, using information indicating the position (seat) from which the utterance was made (information of the sound collection and amplification position, outside the vehicle, corresponding to the call partner), it is determined which filter of the transfer function multiplying unit (the filter corresponding to the position of a desired virtual sound source) is to be applied. In other words, the filter corresponding to the position of a desired virtual sound source is determined from the information of the sound collection and amplification position, outside the vehicle, corresponding to the call partner. The correspondence between points of speech and filters may be set in advance, and the system may make the determination each time.

Figure 14:
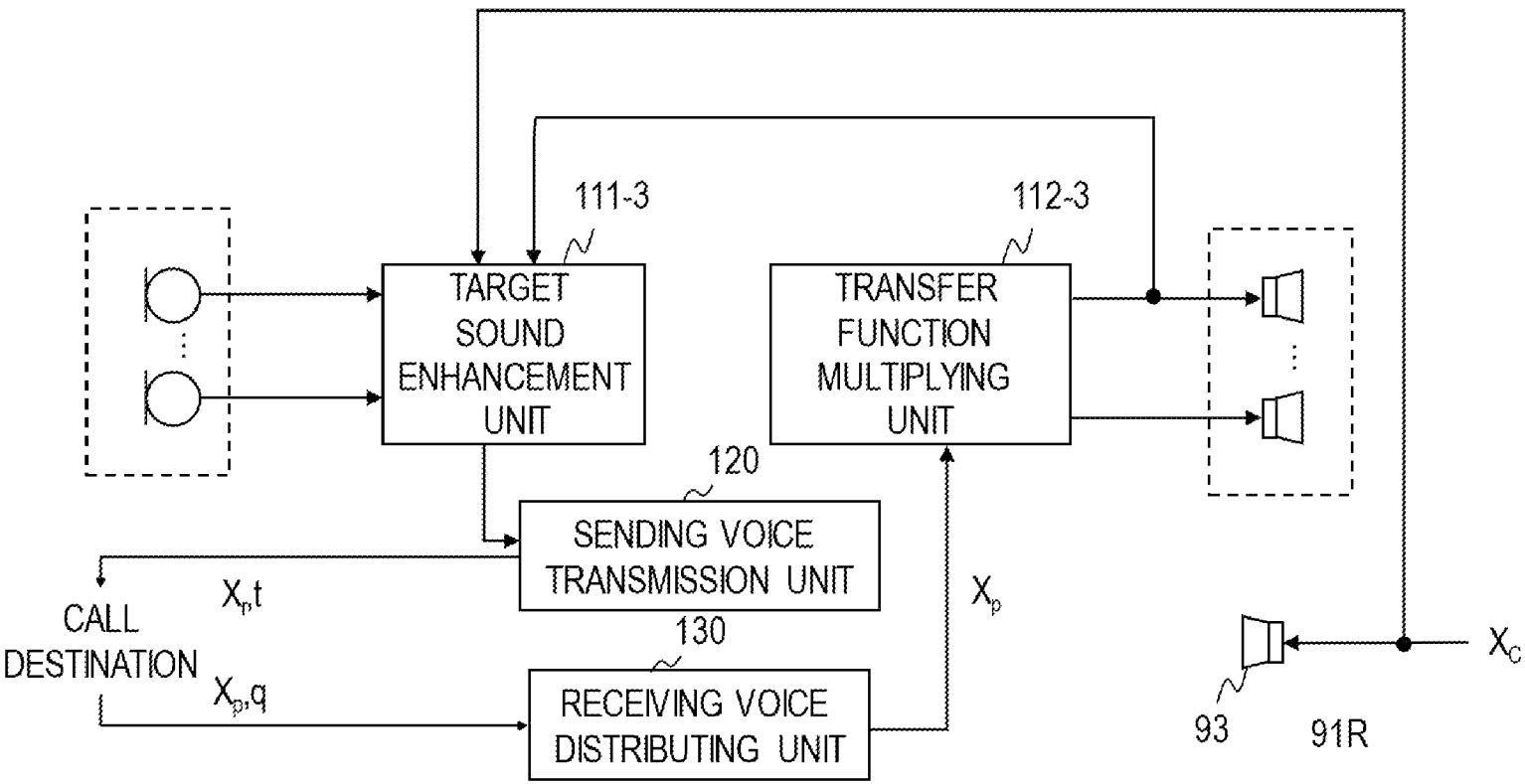
FIG. 14 is a function block diagram illustrating a sound collection loudspeaker apparatus having only an outside-vehicle calling function.
Figure 15:
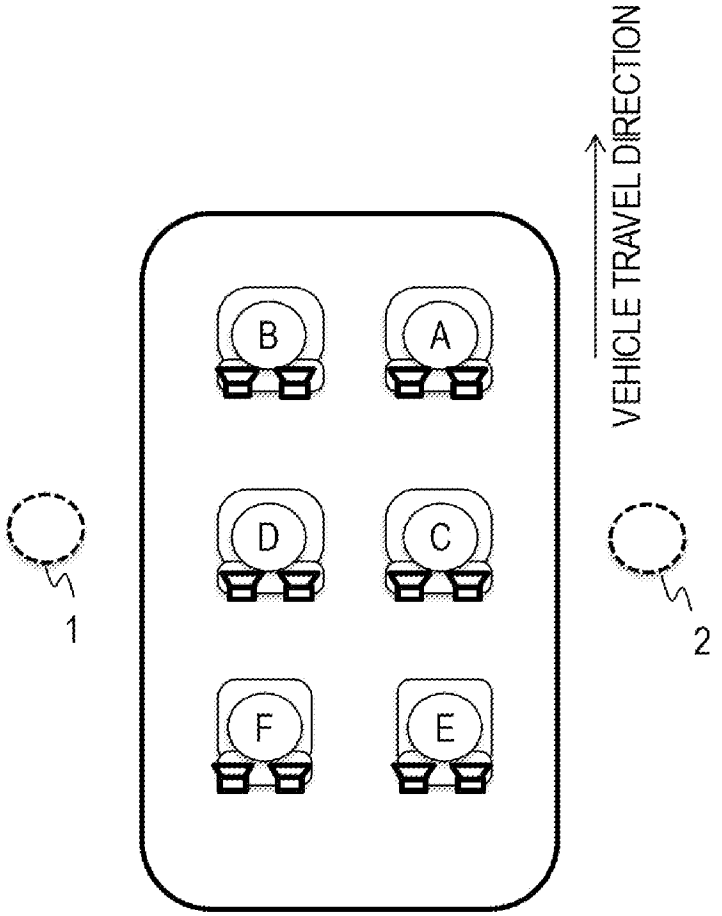
FIG. 15 is a diagram illustrating a virtual sound source position.
Figure 16:
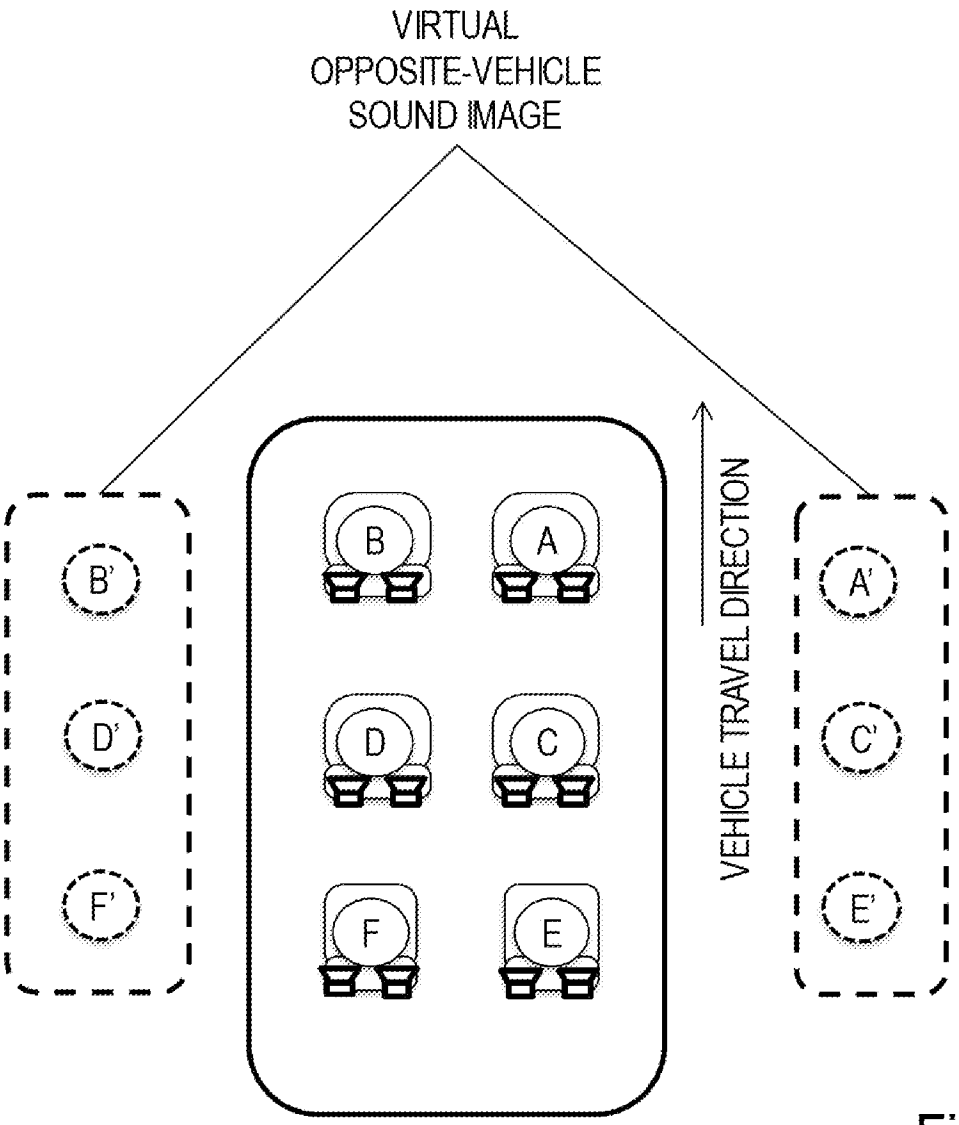
FIG. 16 is a diagram illustrating a virtual sound source position.

Note that in a case where in-vehicle communication speakers are not provided for seats in the second row of a vehicle having three rows of seats, it is also possible to have only an outside-vehicle calling function, as illustrated in FIG. 14. FIG. 15 and FIG. 16 illustrate an example of sound image localization for the second row. The details of the processing performed by the target sound enhancement unit 111-3 and the transfer function multiplying unit 112-3 may be the same signal processing as that carried out by the target sound enhancement unit 111-*j* and the transfer function multiplying unit 112-*k*, in accordance with the input signals and the output signals, and the processing therefore will not be described here.

<Effects>

By employing such a configuration, it is possible to intuitively distinguish which talker is talking, and improve the comfort of conversations, when performing in-car communication and conversations with people outside of a vehicle.

<Variations>

It is possible to use the sound collection loudspeaker apparatus according to the present embodiment for in-vehicle communication only. In this case, neither the sending voice transmission unit 120 nor the receiving voice distributing unit 130 need be provided.

Figure 17:
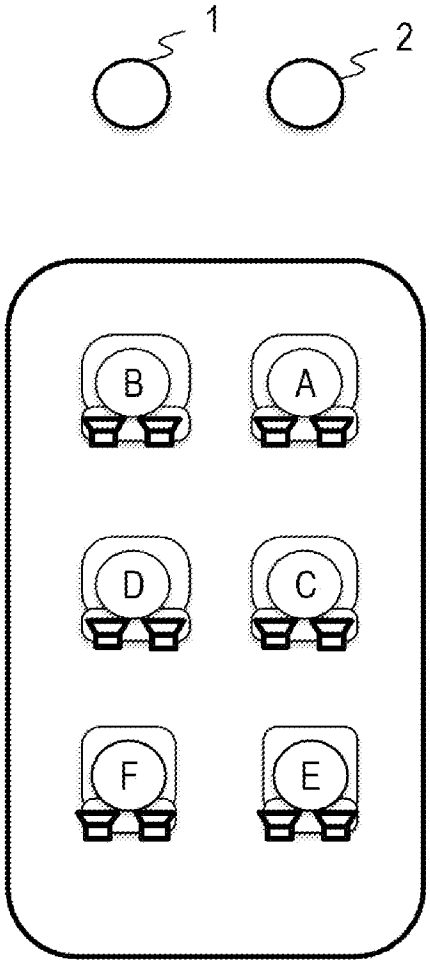
FIG. 17 is a diagram illustrating an example of a screen displayed by input/output means.

In the present embodiment, it is possible to converse with the front seats A and B, the rear seats E and F, and furthermore, with call destinations as well. However, the configuration may be such that it is only possible to pass with a specific call partner. For example, assume a configuration in which a touch panel (input/output means) which displays a screen such as that in FIG. 17 and accepts an input from a user is provided in each seat, and when the user selects a call partner, communication with the selected call partner is started. For example, when a user in the driver's seat (seat A) taps seat F, the microphones 91F and 91R and the speakers 92-RF-L, 92-RF-R, 92-LR-L, and 92-LR-R operate. The sound collection loudspeaker apparatus may operate only the parts necessary to generate the playback signals $Y_{LR-R}$, $Y_{LR-L}$, $Y_{RF-R}$, and $Y_{RF-L}$.

In the present embodiment, the acoustic processing unit 110-*i* includes the target sound enhancement unit 111-*j*. However, if, for example, a directional microphone having directionality with respect to the seat from which sound is to be collected is used to obtain an enhanced signal in which the target sound emitted from the seat is enhanced, an output value from the directional microphone may be output to the transfer function multiplying unit 112-*k* without using the target sound enhancement unit 111-*j*. Furthermore, an output value from the directional microphone may be output to the echo canceler unit 111-*j*-2, without using the directional sound collecting unit 111-*j*-1.

The present embodiment describes a configuration having three rows of seats, with microphones and speakers provided in the first row and the third row. This is because in case of conversation between seats in the first row and second row, or seats in the third row and the second row, it is easy for voice to reach, and in-vehicle communication will not be necessary in most cases. However, this does not preclude a configuration in which a microphone and a speaker are installed in the second row, and these may be provided as necessary. By setting the seats (sound collection and amplification positions) and the virtual sound source positions for the second row, the present embodiment can be applied. Furthermore, the present embodiment is not limited to a vehicle having three rows of seats, and may be applied in a vehicle having two, or four or more, rows of seats as well. In sum, the present embodiment may be applied in cases where people are in a positional relationship where it is difficult for them to hear each others' voices at a typical conversational volume due to travel noise, sounds being played back by the car audio system, other noise from outside the vehicle, and so on, in a common sound field within the vehicle. Setting the virtual sound source positions so that talkers can be distinguished makes it possible to achieve the same effects as those of the present embodiment.

Although the present embodiment describes the sound collection loudspeaker apparatus as having a configuration that does not include the speakers and microphones, the present invention will be described next as a sound collection loudspeaker apparatus which includes a speaker and a microphone. The sound collection loudspeaker apparatus is installed in a vehicle. At least one of the seats in the front row of the vehicle is set as a sound collection position (e.g., the seat A), and at least one of the seats in the rear row of the vehicle is set as an amplification position (e.g., the seat F). Speakers (e.g., the speakers 92-LR-R and 92-LR-L) are installed for amplifying voice at the amplification position (e.g., the seat F), and are installed closer to the amplification position (e.g., the seat F) than a sound collection position (e.g., the seat A) and in a direction different from the sound collection position (e.g., the seat A) relative to the amplification position (e.g., the seat F) (see FIGS. 2, 8, and the like). Additionally, a microphone (e.g., the microphone 91F) is installed to collect sound emitted from the sound collection position (e.g., the seat A). The sound picked up by the microphone (e.g., the microphone 91F) is amplified from the speakers (e.g., the speakers 92-LR-R and 92-LR-L) with the sound image of that sound having been localized to the sound collection position (e.g., the seat A). Note that "sound collection" means "collecting sound", whereas "picking up" a sound means "receiving a sound with a microphone and collecting the sound as an electrical signal".

<Other Variations>

The present invention is not intended to be limited to the embodiments and variations described thus far. For example, the various types of processing described above need not be executed in time series as per the descriptions, and may instead be executed in parallel or individually as necessary or in accordance with the processing capabilities of the device executing the processing. Other changes can be made as appropriate within a scope that does not depart from the essential spirit of the present invention.

<Program and Recording Medium>

Additionally, the various processing functions in each apparatus described in the foregoing embodiments and variations may be implemented by a computer. In this case, the processing details of the functions which the apparatus is to have are written in a program. The various processing functions in each apparatus described above are implemented by the computer as a result of the computer executing the program.

The program in which the processing details are written can be recorded into a computer-readable recording medium. Magnetic recording devices, optical discs, magneto-optical recording media, semiconductor memory, and the like are examples of computer-readable recording media.

Additionally, the program is distributed by, for example, selling, transferring, or lending portable recording media such as DVDs and CD-ROMs in which the program is recorded. Furthermore, the program may be distributed by storing the program in a storage device of a server computer and transferring the program from the server computer to another computer over a network.

A computer executing such a program first stores the program recorded on the portable recording medium or the program transferred from the server computer in its own storage unit, for example. Then, when executing the processing, the computer reads the program stored in its own storage unit and executes the processing in accordance with the read program. As another embodiment of this program, the computer may read the program directly from a portable recording medium and execute processing according to the program. Furthermore, each time a program is transferred to the computer from the server computer, processing according to the received programs may be executed sequentially. Additionally, the configuration may be such that the above-described processing is executed by what is known as an ASP (Application Service Provider)-type service that implements the functions of the processing only by instructing execution and obtaining results, without transferring the program from the server computer to the computer in question. Note that the program includes information that is provided for use in processing by an electronic computer and that is based on the program (such as data that is not a direct command to a computer but has a property of defining processing by the computer).

Additionally, although each apparatus is configured by causing a computer to execute a predetermined program, the details of the processing may be at least partially realized by hardware.

The invention claimed is:

1. A sound collection loudspeaker apparatus installed in a vehicle, wherein the vehicle comprising:

one or more speakers, two or more sound collection and amplification positions located inside the vehicle, one or more sound collection and amplification positions located outside the vehicle, and the apparatus comprises:

processing circuitry configured to:

transmit, to a call destination, an enhanced signal that has not been filtered, information of a sound collection and amplification position that corresponds to that enhanced signal and is located within the vehicle, and information of a sound collection and amplification position that corresponds to a call partner and that is located inside the vehicle;

receive a voice signal from the call destination, information q1 of a sound collection and amplification position that corresponds to the voice mail and that is located within the vehicle, and information q2 of a sound collection and amplification position that corresponds to the call partner and that is located outside the vehicle, specify the filter to apply to the enhanced signal from the information q1 and q2, and output the voice signal; and from a transfer function for transfer from a desired sound source position where a sound image of an enhanced signal is localized to both ears of a target person located at the sound collection and amplification position, and a transfer function for transfer from the one or more speakers for playing back sound at the sound collection and amplification position to the ears, apply a filter for localizing a sound image at the sound source position to the enhanced signal, and outputs the enhanced signal that has been filtered to the speaker, wherein the transfer function for transfer from the desired sound source position and the transfer function for transfer from the one or more speakers are registered by the apparatus; and the enhanced signal is a signal in which a target sound emitted from the sound collection and amplification position has been enhanced from a signal collected by the one or more microphones.

2. A non-transitory computer-readable recording medium stored thereon a program, when executed by a computer, for causing the computer to function as the sound collection loudspeaker apparatus according to claim 1.

3. A sound collection loudspeaker method, implemented by a sound collection loudspeaker apparatus that includes processing circuitry, provided in a vehicle, wherein the vehicle comprising:

one or more speakers, two or more sound collection and amplification positions located inside the vehicle, one or more sound collection and amplification positions located outside the vehicle, the apparatus registers a transfer function for transfer from a desired sound source position where a sound image of an enhanced signal is localized to both ears of a target person located at the sound collection and amplification position, and a transfer function for transfer from the one or more speakers for playing back sound at the sound collection and amplification position to the ears, and the method comprises:

transmitting, by the processing circuitry, to a call destination, the enhanced signal that has not been filtered, information of a sound collection and amplification position that corresponds to that enhanced signal and is located within the vehicle, and information of a sound collection and amplification position that corresponds to a call partner and that is located outside the vehicle;

receiving, by the processing circuitry, a voice signal from the call destination, information q1 of a sound collection and amplification position that corresponds to the voice signal and that is located within the vehicle, and information q2 of a sound collection and amplification position that corresponds to the call partner and that is located outside the vehicle, specifies the filter to apply to the enhanced signal from the information q1 and q2, and outputs the voice signal; and from the transfer function for transfer from the desired sound source position and the transfer function for transfer from the one or more speakers, applying, by the processing circuitry, a filter for localizing a sound image at the sound source position to the enhanced signal, and outputting the enhanced signal that has been filtered to the speaker, wherein the enhanced signal is a signal in which a target sound emitted from the sound collection and amplification position has been enhanced from a signal collected by the one or more microphones.

* * * * *